US009155147B2

(12) United States Patent
Kim et al.

(10) Patent No.: US 9,155,147 B2
(45) Date of Patent: Oct. 6, 2015

(54) LIGHT EMITTING DIODE ILLUMINATION APPARATUS AND CONTROL METHOD THEREOF

(71) Applicant: SILICON WORKS CO., LTD., Daejeon-si (KR)

(72) Inventors: Yong Geun Kim, Suwon-si (KR); Sang Young Lee, Jeonju-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 0 days.

(21) Appl. No.: 14/193,476

(22) Filed: Feb. 28, 2014

(65) Prior Publication Data

US 2014/0239847 A1 Aug. 28, 2014

(30) Foreign Application Priority Data

Feb. 28, 2013 (KR) ..... 10-2013-0021906

(51) Int. Cl.
*H05B 33/08* (2006.01)

(52) U.S. Cl.
CPC ..... *H05B 33/0818* (2013.01)

(58) Field of Classification Search
USPC ..... 315/291, 185 R, 193, 307, 308, 224, 315/209 R; 363/124
See application file for complete search history.

(56) References Cited

U.S. PATENT DOCUMENTS

2010/0309696 A1* 12/2010 Guillot et al. ..... 363/124
2012/0081009 A1* 4/2012 Shteynberg et al. ..... 315/122
2014/0312771 A1* 10/2014 Lee et al. ..... 315/113

* cited by examiner

*Primary Examiner* — David H Vu
(74) *Attorney, Agent, or Firm* — Kile Park Reed & Houtteman PLLC

(57) ABSTRACT

Disclosed are a light emitting diode illumination apparatus and a control method thereof. The light emitting diode illumination apparatus includes a light source that includes a plurality of light emitting diode channels including one or more light emitting diodes, and emits light by application of a rectified voltage obtained by converting an AC voltage, and a control circuit that selectively provides current paths according to a change in a level of the rectified voltage through a plurality of switching circuits connected to the light emitting diode channels, and controls pulse widths of control pulses provided to the switching circuits such that an current supplied to the light source of each channel follows a waveform of the rectified voltage.

15 Claims, 3 Drawing Sheets

LIGHT EMITTING DIODE ILLUMINATION APPARATUS AND CONTROL METHOD THEREOF

BACKGROUND OF THE INVENTION

1. Field of the Invention

The present invention relates to an illumination apparatus, and more particularly, to a light emitting diode illumination apparatus and a control method thereof.

2. Description of the Related Art

For energy reduction, an illumination technology employing a light emitting diode (LED) as a light source has been continuously developed.

Particularly, a high brightness light emitting diode has advantages differentiated from other light sources in various factors such as an energy consumption amount, lifespan, or light quality.

However, an illumination apparatus employing a light emitting diode as a light source has a problem that many additional circuits are necessary due to a characteristic in which the light emitting diode is driven by a current.

An example developed in order to solve such a problem is an AC direct type illumination.

Since an AC direct type light emitting diode illumination generates a rectified voltage from commercial AC power to drive a light emitting diode and directly uses the rectified voltage as an input voltage, the AC direct type light emitting diode illumination has a good power factor.

An example of the aforementioned AC direct type light emitting diode apparatus is disclosed in Korean Patent Registration No. 10-1128680.

However, with the widespread of a light emitting diode illumination, an illumination apparatus employing a light emitting diode as a light source is required to guarantee low power consumption and an improved power factor, and to have simple parts and a simple structure.

SUMMARY OF THE INVENTION

Accordingly, the present invention has been made in an effort to solve the problems occurring in the related art, and an object of the present invention is to provide an illumination apparatus including light emitting diodes having an improved power factor as light sources.

Another object of the present invention is to provide a light emitting diode illumination apparatus that monitors the state of a rectified voltage to control an illumination, and improves current regulation such that an current required in light emission is controlled, and a control method thereof.

In order to achieve the above object, according to one aspect of the present invention, there is provided a light emitting diode illumination apparatus including: a light source that includes a plurality of light emitting diode channels including one or more light emitting diodes, and emits light by application of a rectified voltage obtained by converting an AC voltage; and a control circuit that selectively provides current paths according to a change in a level of the rectified voltage through a plurality of switching circuits connected to the light emitting diode channels, and controls pulse widths of control pulses provided to the switching circuits such that an current supplied to the light source of channel follows a waveform of the rectified voltage.

In order to achieve the above object, according to one aspect of the present invention, there is provided a control method of a light emitting diode illumination apparatus including the steps of: providing a plurality of light emitting diode channels; providing reference voltages for providing current paths according to the light emitting diode channels; monitoring a change in the rectified voltage and providing a monitoring voltage; and providing a current path to a light emitting diode channel selected from the light emitting diode channels according to a result obtained by comparing the monitoring voltage with the reference voltages, and controlling an current supplied to the light source of channel to follow a waveform of the rectified voltage by using a control pulse having a pulse width that changes.

According to the present invention, the supply of a current for the illumination is controlled according to a change in a rectified voltage, so that it is possible to ensure improved current regulation characteristics.

According to the present invention, distortion of current harmonics flowing through commercial power (AC power) can be reduced and a current waveform is formed more smoothly according to a voltage waveform, so that the distortion of the current waveform can be attenuated.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
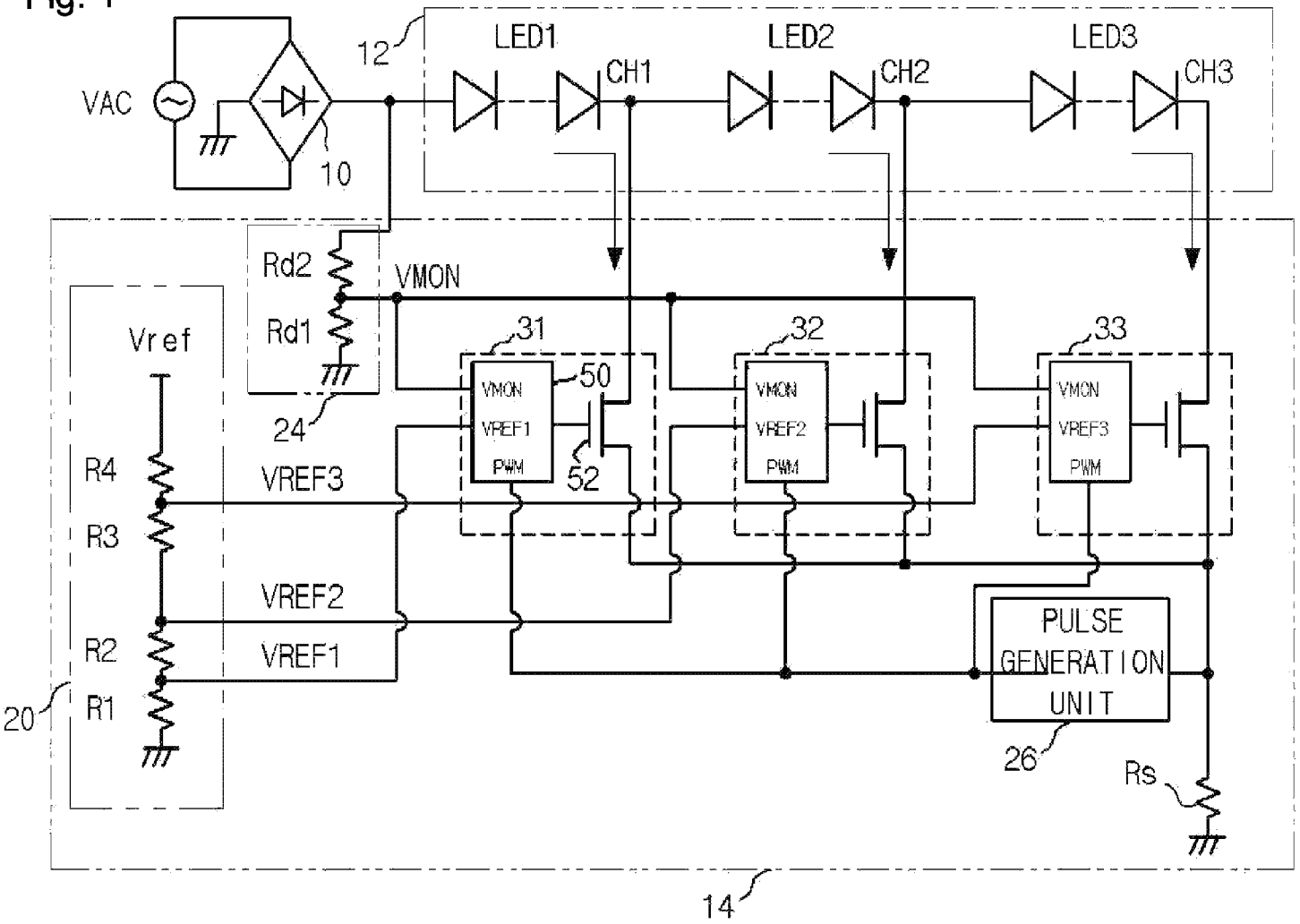
FIG. 1 is a circuit diagram illustrating a preferred embodiment of a light emitting diode illumination apparatus according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

A light emitting diode illumination apparatus according to an embodiment of the present invention is driven in an AC direct manner. The embodiment according to the present invention discloses a configuration in which a change in a rectified voltage is detected as a monitoring voltage to control light emission of a light source and a current supplied to the light source is controlled by a control pulse according to a sensing voltage.

Referring to FIG. 1, the embodiment according to the present invention includes a power supply, a light source 12, and a control circuit 14.

The power supply includes AC power VAC that converts an AC voltage to output a rectified voltage and supplies the AC voltage, and a rectification circuit 10 that rectifies the AC voltage to output the rectified voltage. The AC power VAC may include commercial AC power.

The rectification circuit 10 outputs the rectified voltage having a waveform obtained by fully rectifying the AC voltage with a sine waveform of the AC power VAC. Accordingly, the rectified voltage has a characteristic of having a ripple component having a voltage level that rises and falls by the half period of the commercial AC power.

The light source 12 includes a plurality of light emitting diode channels LED1 to LED3 serially connected to one another, and the embodiment according to the present invention discloses a configuration in which the number of the light emitting diode channels is 3.

Each of the light emitting diode channels LED1 to LED3 may include one or more light emitting diodes serially connected to one another, and the embodiment according to the present invention discloses a configuration in which each of the light emitting diode channels LED1 to LED3 includes a plurality of light emitting diodes serially connected to one another. In FIG. 1, among the plurality of light emitting diodes serially connected to one another, only the first and last light emitting diodes are illustrated, and a connection relation of light emitting diodes between the first and last light emitting diodes is omitted and is illustrated by broken lines.

The control circuit 14 divides a variation width of the rectified voltage into a plurality of sections to correspond to the light emission voltage of each of the light emitting diode channels LED1 to LED3. The control circuit 14 has a function of monitoring a change in the rectified voltage to control the light emission of the light source 12 according to the sections, sensing a current flowing through the light emitting diode channels LED1 to LED3 by the current rectified voltage, and controlling a current for light emission. According to the embodiment of the present invention, it is possible to control a constant current by the control circuit 14 and to provide a current path formed by the control circuit 14 as a constant current path.

Each of the light emitting diode channels LED1 to LED3 of the light source 12 emits light under the control of the control circuit 14.

In more detail, when the rectified voltage rises, the light emitting diode channels LED1 to LED3 sequentially emit light from a light emitting diode channel, to which the rectified voltage is applied, to a remote light emitting diode channel, resulting in an increase in the number of light emitting diode channels that emit light.

However, when the rectified voltage falls, the light emitting diode channels LED1 to LED3 sequentially emit no light from the remote light emitting diode channel to the light emitting diode channel to which the rectified voltage is applied, resulting in a decrease in the number of light emitting diode channels that emit light.

At this time, the control circuit 14 provides a current path to a channel corresponding to a current rectified voltage state among the light emitting diode channels LED1 to LED3, thereby controlling light emission.

The light emission of the light source 12 may be controlled by the control circuit 14 as described above, and the control circuit 14 includes a reference voltage generation circuit 20, a current sensing resistor Rs, a monitoring circuit 24, a pulse generation unit 26, and switching circuits 31 to 33.

The reference voltage generation circuit 20 includes a plurality of resistors R1 to R4 to which a constant voltage Vref is applied, which are serially connected to one another.

The resistor R1 is connected to the ground and the constant voltage Vref is applied to the resistor R4. Between the resistor R1 and the resistor R4, the resistor R4 serves as a load resistor for output adjustment.

The resistors R1 to R3 output reference voltages VREF1 to VREF3 having levels different from one another. Among the reference voltages VREF1 to VREF3, the reference voltage VREF1 has the lowest voltage level and the reference voltage VREF3 has the highest voltage level.

Figure 2:
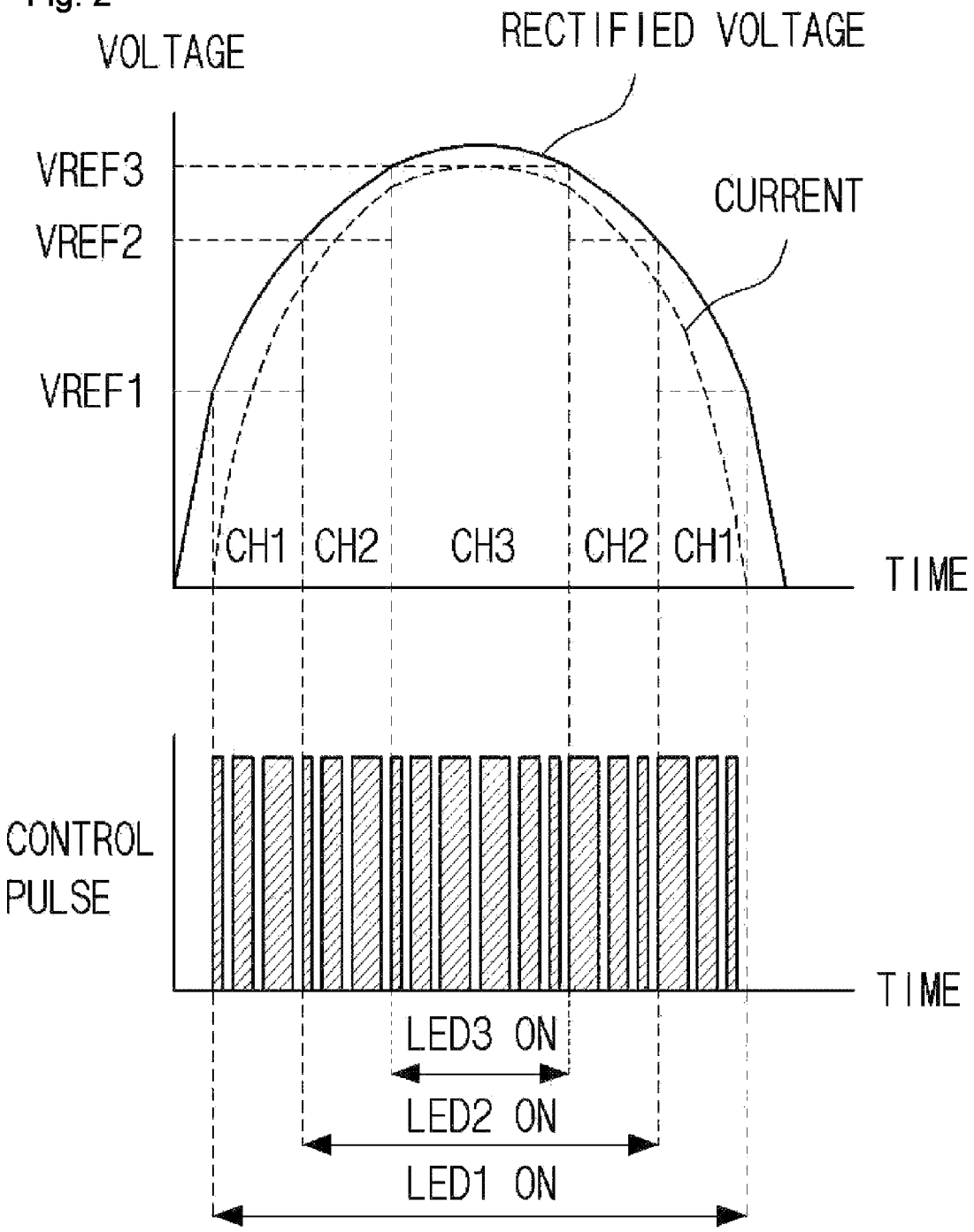
FIG. 2 is a waveform diagram for explaining operation characteristics of an embodiment of FIG. 1.

That is, it is preferable that the resistors R1 to R4 are set to output the reference voltages VREF1 to VREF3 having levels gradually increasing according to the rise of the rectified voltage applied to the light emitting diode channels LED1 to LED3 as illustrated in FIG. 2.

In more detail, the reference voltages VREF1 to VREF3 may be set to correspond to the light emission voltages of the light emitting diode channels LED1 to LED3 connected to the switching circuits 31 to 33, respectively.

The light emission voltages of the light emitting diode channels LED1 to LED3 may be defined as voltages required for the light emission of the channels.

In more detail, a voltage required for the light emission of the light emitting diode channel LED1 is the light emission voltage of the light emitting diode channel LED1, wherein the light emission voltage of the light emitting diode channel LED1 may be defined to have a level at which the light emitting diodes included in the light emitting diode channel LED1 may emit light. Voltages required for the light emission of the light emitting diode channels LED1 and LED2 are the light emission voltage of the light emitting diode channel LED2, wherein the light emission voltage of the light emitting diode channel LED2 may be defined to have a level at which the light emitting diodes included in the light emitting diode channels LED1 and LED2 may emit light. Voltages required for the light emission of the light emitting diode channels LED1 to LED3 are the light emission voltage of the light emitting diode channel LED3, wherein the light emission voltage of the light emitting diode channel LED3 may be defined to have a level at which the light emitting diodes included in the light emitting diode channels LED1 to LED3 may emit light.

The rectified voltage may be divided into a plurality of sections based on the light emission voltages, the reference voltages may be set to have levels corresponding to the light emission voltages of the sections, and when the rectified voltage rises or falls to enter a specific section, light emitting diode channels corresponding to the corresponding section may emit light or not.

The monitoring circuit 24 includes resistors Rd1 and Rd2 serially connected to each other in order to divide the rectified voltage output from the rectification circuit 10, wherein a monitoring voltage VMON is output through a node between the resistors Rd1 and Rd2. The monitoring voltage VMON has a level following a change in the rectified voltage.

A pulse generation circuit includes the pulse generation unit 26 and the current sensing resistor Rs.

The current sensing resistor Rs receives a current flowing from a turned-on switching circuit and receives a sensing voltage by the flowing current.

The pulse generation unit 26 receives the sensing voltage of the current sensing resistor Rs, is rest at the time point at which a current path is changed, and provides the switching circuits 31 to 33 with a control pulse having a pulse width that gradually increases or decreases according to the rise or fall of the rectified voltage.

In more detail, the pulse generation unit 26 resets the control pulse that is output at the time point at which current paths are changed according to the switching circuits 31 to 33. The time point at which the current paths are changed may be determined with reference to a change in the sensing voltage. At this time, the pulse generation unit 26 may provide a plurality of control pulses having pulse widths different from one another according to the sections CH1 to CH3, minimum pulse widths may be set to be equal to one another according to the sections CH1 to CH3 in correspondence with the rise of the rectified voltage, and maximum pulse widths may be set to be equal to one another according to the sections CH1 to CH3 in correspondence with the fall of the rectified voltage. Within the sections CH1 to CH3, the pulse generation unit 26 generates control pulses such that their pulse widths gradually increase in correspondence with the rise of the rectified voltage and gradually decrease in correspondence with the fall of the rectified voltage.

In the state in which the pulse width of the control pulse has been reset according to the sections in correspondence with the rise of the rectified voltage, in the case of outputting the pulse with to gradually increase, the pulse generation unit 26 may increase a width of a control pulse sequentially next time, such as twice, three times, and four times or twice, four times, and eight times as long as a pulse width of an initial control pulse, based on the initial control pulse.

Of course, the aforementioned setting of the pulse width is for illustrative purposes only, and the pulse width may be changed according to an increase in the number of the light emitting diode channels, which may be variously implemented according to the intention of a manufacturer.

Meanwhile, in the state in which the pulse width of the control pulse has been reset according to the sections in correspondence with the fall of the rectified voltage, in the case of outputting the pulse with to gradually decrease, the pulse generation unit 26 may decrease the width of the control pulse sequentially next time, such as ½ times, ⅓ times, and ¼ times or ½ times, ¼ times, and ⅛ times as long as the pulse width of the initial control pulse, based on the initial control pulse.

It is preferable that the pulse generation unit 26 provides the initial control pulse such that the pulse width of the initial control pulse corresponding to the rise of the rectified voltage is different from the pulse width of the initial control pulse corresponding to the fall of the rectified voltage.

The switching circuits 31 to 33 provide current paths, through which the light source 12 emits light, through switching.

Each of the switching circuits 31 to 33 includes a comparison unit 50 and a switching unit. The switching unit may include a NMOS transistor 52.

The comparison units 50 compare the monitoring voltage VMON with the reference voltages VREF1 to VREF3, and output switching pulses corresponding to a comparison result. At this time, the comparison units 50 output the switching pulses to have pulse widths corresponding to the pulse widths of the control pulses provided from the pulse generation unit 26. The NMOS transistors 52 perform a switching operation for providing current paths by the switching pulses of the comparison units 50.

Although not illustrated in detail, each comparison unit 50 may include a comparator (not illustrated) that compares the reference voltage with the monitoring voltage and outputs a comparison result, and a switching pulse driving section (not illustrated) that switches the output of the comparator by the control pulse of the pulse generation unit 26 and outputs a switching pulse. The switching pulse driving section may include a current limiter.

The reference voltages VREF1 to VREF3 having higher levels are provided to the switching circuits 31 to 33 connected to the light emitting diode channels LED1, LED2, . . . , LEDn remote from the position to which the rectified voltage is applied. In other words, when the number of the light emitting diode channels included in the light source 12 is N, a level of a reference voltage provided to a switching circuit corresponding to the Nth light emitting diode channel is higher than that of a reference voltage provided to a switching circuit corresponding to the N−1th light emitting diode channel.

By the aforementioned configuration, the switching circuits 31 to 33 compare their own reference voltages with the monitoring voltage VMON that changes by the rectified voltage.

Each comparator 50 of the switching circuits 31 to 33 outputs a switching pulse driven by a control pulse to the NMOS transistor 52 when the monitoring voltage VMON is lower than each reference voltage, and the NMOS transistor 52 provides a current path in response to the switching pulse.

Meanwhile, when the monitoring voltage VMON rises beyond each reference voltage, each comparator 50 outputs no switching pulse and the NMOS transistor 52 is turned off in response to the non-output of the switching pulse and provides no current path.

A detailed operation of the embodiment configured as illustrated in FIG. 1 according to the present embodiment will be described with reference to FIG. 2.

FIG. 2 is a waveform diagram illustrating the case where three light emitting diode channels LED1 to LED3 are driven.

In FIG. 2, it is noted that the rectified voltage is divided into sections CH1 to CH3 based on voltage values, at the time point at which the light emitting diode channels LED1 to LED3 emit light, that is, light emission voltages, and the reference voltages VREF1 to VREF3 having different levels are set according to the sections CH1 to CH3. In FIG. 2, when the sections CH1 to CH3 are subdivided, the levels of the reference voltages may be designed to actually follow a change in the rectified voltage.

Since the rectified voltage has a waveform obtained by fully rectifying the AC voltage VAC, the rectified voltage has a ripple component with a level repeatedly rising and falling by the half period of the AC voltage VAC.

The switching circuits 31 to 33 compare the reference voltages VREF1 to VREF3 with the monitoring voltage VMON to selectively provide current paths, and are turned off when the monitoring voltage VMON is higher than the reference voltages VREF1 to VREF3.

The monitoring voltage VMON according to the rectified voltage in an initial state is lower than the reference voltages VREF1 to VREF3. Accordingly, the switching circuits 31 to 33 maintain a turn-on state.

When the rectified voltage rises and reaches the light emission voltage of the light emitting diode channel LED1, the light emitting diode channel LED1 emits light. When the light emitting diode channel LED1 emits light, a current path is provided by the switching circuit 31, and a current is supplied to the current sensing resistor Rs from the switching circuit 31, so that a sensing voltage is generated.

When the rectified voltage rises, the monitoring voltage VMON of the monitoring circuit 24 also rises, and when the rectified voltage reaches a light emission voltage at which the light emitting diode channel LED2 may emit light, the monitoring voltage VMON also rises beyond the reference voltage VREF1.

That is, the comparison unit 50 of the switching circuit 31 maintains a turn-on state of the NMOS transistor 52 until the light emitting diode channel LED2 emits light, and turns off the NMOS transistor 52 when the monitoring voltage VMON is higher than the reference voltage VREF1 according to the rise of the rectified voltage. The turn-on and turn-off of the NMOS transistor 52 indicates the turn-on and turn-off of the switching circuit 31. This may be applied to the switching circuits 32 and 33 in the same manner which will be described later.

In the state in which the switching circuit 31 has been turned on, the pulse generation unit 26 receives the sensing voltage generated according to the flow of the current of the current sensing resistor Rs, generates control pulses, and provides the control pulses to a pulse input terminal PWM of the comparison unit 50 of the switching circuit 31.

The comparison unit 50 of the switching circuit 31 provides the NMOS transistor 52 with a switching pulse having a pulse width corresponding to the control pulse of the pulse input terminal PWM. Thus, the NMOS transistor 52 is driven by the switching pulse of the section CH1 of FIG. 2, so that the flow of a current on the current path is controlled.

That is, the light emitting diode channel LED1 emits light when the rectified voltage rises beyond its own light emission voltage, and the flow of the current on the current path is controlled by the switching pulse having a pulse width corresponding to the rise of the rectified voltage.

It is preferable that the pulse widths of the control pulses for controlling the flow of the current gradually increase within the section CH1 according to the rise of the rectified voltage.

The increase in the pulse widths is for linearly increasing an current to improve current efficiency.

After the light emitting diode channel LED1 emits light, when the rectified voltage continuously rises and reaches the light emission voltage of the light emitting diode channel LED2, the light emitting diode channels LED1 and LED2 emit light. When the light emitting diode channel LED2 emits light, a current path is provided by the switching circuit 32, and a current is supplied to the current sensing resistor Rs from the switching circuit 32. At this time, since the switching circuit 31 is turned off because the monitoring voltage VMON is higher than the reference voltage VREF1.

When the rectified voltage rises, the monitoring voltage VMON of the monitoring circuit 24 also rises, and when the rectified voltage reaches a light emission voltage at which the light emitting diode channel LED3 may emit light, the monitoring voltage VMON also rises beyond the reference voltage VREF2.

That is, the comparison unit 50 of the switching circuit 32 maintains the turn-on state of the NMOS transistor 52 until the light emitting diode channel LED3 emits light, and turns off the NMOS transistor 52 when the monitoring voltage VMON is higher than the reference voltage VREF2.

In the state in which the switching circuit 32 has been turned on, the pulse generation unit 26 generates control pulses having pulse widths gradually increasing within the section according to the rise of the rectified voltage as described above, and provides the control pulses to a pulse input terminal PWM of the comparison unit 50 of the switching circuit 32.

The comparison unit 50 of the switching circuit 32 provides the NMOS transistor 52 with a switching pulse having a pulse width corresponding to the control pulse of the pulse input terminal PWM. Thus, the NMOS transistor 52 is driven by the switching pulse of the section CH2 of FIG. 2, so that the flow of a current on the current path is controlled.

That is, the light emitting diode channel LED2 emits light when the rectified voltage rises beyond its own light emission voltage, and the flow of the current on the current path is controlled by the switching pulse having a pulse width corresponding to the rise of the rectified voltage.

After the light emitting diode channels LED1 and LED2 emit light, when the rectified voltage continuously rises and reaches the light emission voltage of the light emitting diode channel LED3, the light emitting diode channels LED1 to LED3 emit light. When the light emitting diode channel LED3 emits light, a current path is provided by the switching circuit 33, and a current is supplied to the current sensing resistor Rs from the switching circuit 33. The switching circuit 32 is turned off because the monitoring voltage VMON is higher than the reference voltage VREF2.

A current flows through the current sensing resistor Rs through the current path by the switching circuit 33, and the pulse generation unit 26 is driven by the application of the sensing voltage to the current sensing resistor Rs, generates control pulses, and provides the control pulses to a pulse input terminal PWM of the comparison unit 50 of the switching circuit 33.

In a turn-on state, the comparison unit 50 of the switching circuit 33 provides the NMOS transistor 52 with a switching pulse having a pulse width corresponding to the control pulse of the pulse input terminal PWM. Thus, the NMOS transistor 52 is driven by the switching pulse of the section CH3 of FIG. 2, so that the flow of the current on the current path is controlled.

That is, the light emitting diode channel LED3 emits light when the rectified voltage rises beyond its own light emission voltage, and the flow of the current is controlled by the switching pulse having a pulse width following the level of the sensing voltage corresponding to the current on the current path.

In the embodiment of FIG. 1 according to the present invention, the current path changes in an order from the switching circuit 31 to the switching circuit 33 according to the rise of the rectified voltage. That is, the current path is shifted from the position at which the rectified voltage is applied to a remote position.

The level of the sensing voltage rises according to the rise of the rectified voltage, the pulse generation unit 26 provides the control pulse having a pulse width (Duty) gradually increasing in each section according to the rise of the rectified voltage as described above, and the pulse width of the switching pulse applied to the NMOS transistor 52 also gradually increases as the width of the control pulse is large.

After all the light emitting diode channels LED1 to LED3 emit light, the rectified voltage falls.

When the rectified voltage starts to fall, the light emitting diode channels emit no light in sequence of LED3, LED2, and LED1. Thus, the current paths by the switching circuits 31 to 33 are also sequentially shifted from a remote position to a near position based on the position at which the rectified voltage is applied. As the rectified voltage falls, the pulse generation unit 26 employs, as an initial pulse, a control pulse having a wider pulse width in each section in contrast to the case where the rectified voltage rises, and provides a control pulse having a pulse width gradually decreasing, resulting in a change in a pulse width of a switching pulse.

As described above, in the embodiment of FIG. 1, when the rectified voltage rises or falls, the light emitting diode channels LED1 to LED3 sequentially emit light or not.

Furthermore, a width of a switching pulse for controlling a current is changed according to the rise or fall of the rectified voltage, so that a change in an current required for light emission of the light emitting diode channels follows a change in the rectified voltage. That is, a large amount of current is supplied in order to allow a large number of light emitting diodes to emit light, and a small amount of current is supplied in order to allow a small number of light emitting diodes to emit light.

As described above, in the embodiment according to the present invention, an inductor or a capacitor is not used and a monitoring voltage following a rectified voltage in each channel is applied, so that it is possible to guarantee an optimal power factor and to ensure sufficient current regulation characteristics.

Furthermore, in the embodiment according to the present invention, current paths are provided to light emitting diode channels by using one current sensing resistor, so that parts constituting a light emitting diode driving circuit are simplified, resulting in the achievement of a circuit with a simple structure.

Figure 3:
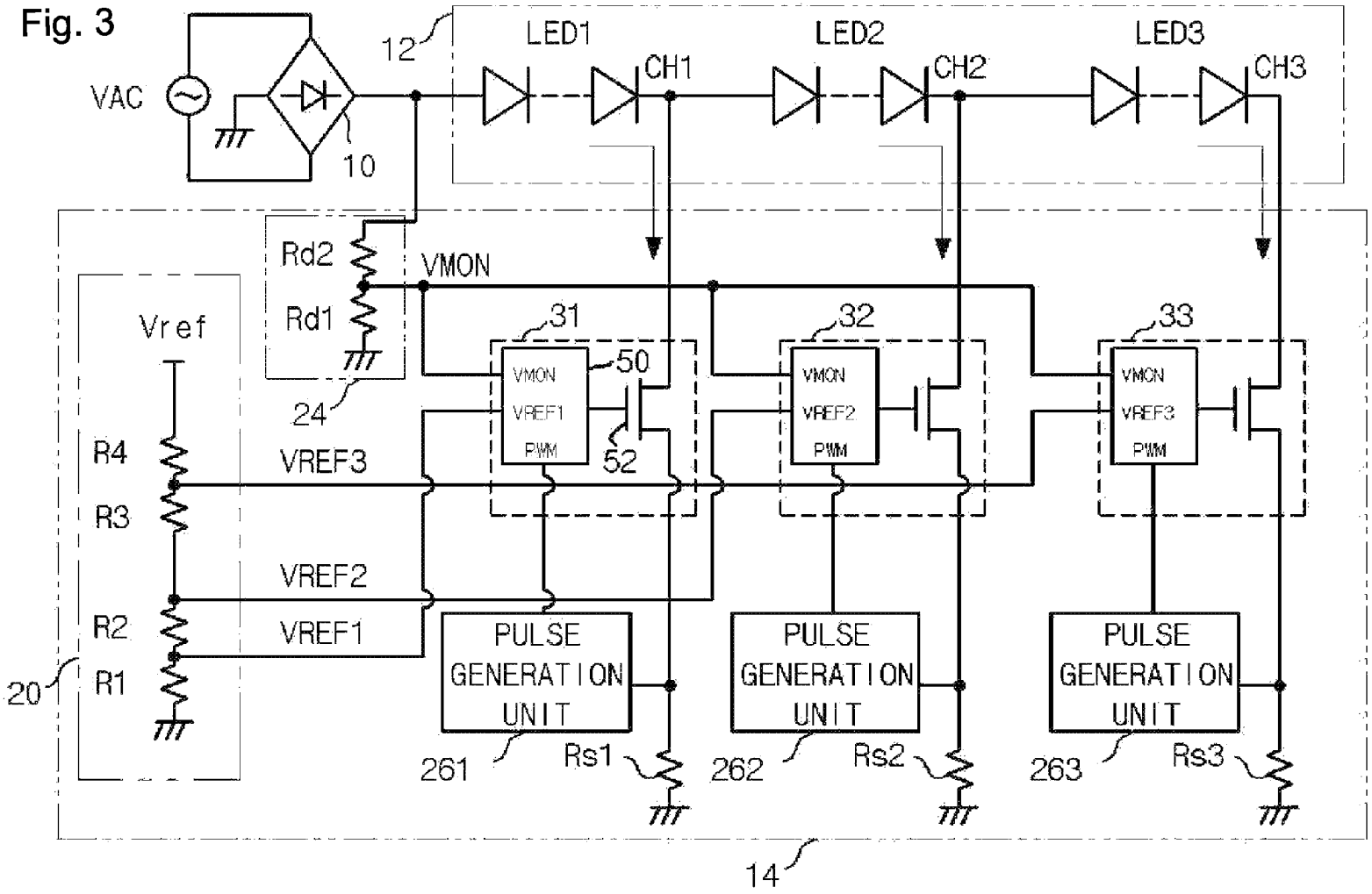
FIG. 3 is a circuit diagram illustrating of a modified embodiment of FIG. 1.

In addition, the embodiment according to the present invention may be implemented by independently providing pulse generation circuits according to the switching circuits 31 to 33 as illustrated in FIG. 3, wherein the pulse generation circuits include a current sensing resistor Rs1 and a pulse generation unit 261, a current sensing resistor Rs2 and a pulse generation unit 262, and a current sensing resistor Rs3 and a pulse generation unit 263, respectively.

The embodiment of FIG. 3 is different from the embodiment of FIG. 1 in that independent pulse generation circuits including the pulse generation unit 261 and the current sensing resistor Rs1, the pulse generation unit 262 and the current sensing resistor Rs2, and the pulse generation unit 263 and the current sensing resistor Rs3 are provided to the switching circuits 31 to 33. Since the other elements are the same as those of FIG. 1, a configuration and an operation thereof will be omitted in order to avoid redundancy.

In the configuration of FIG. 3, it is preferable that each of the current sensing resistors Rs1, Rs2, and Rs3 has a uniform resistance value to satisfy a turn-on condition of each of the switching circuits 31 to 33.

In the embodiment of FIG. 3, the light emitting diode channels LED1 to LED3 increase one by one to emit light or decrease one by one to emit no light according to the rise and fall of the rectified voltage similarly to the embodiment of FIG. 1.

The switching circuits 31 to 33 in an initial state maintain a turn-on state according to the difference between the monitoring voltage VMON and their own reference voltages VREF1 to VREF3.

When the light emitting diode channels LED1 to LED3 sequentially emit light according to the rise of the rectified voltage, current paths are also shifted by the switching circuits 31 to 33 and are sequentially provided.

When the light emitting diode channel LED1 emits light, a current path is provided by the switching circuit 31, and a current is supplied to the current sensing resistor Rs1. When the light emitting diode channels LED1 and LED2 emit light, a current path is provided by the switching circuit 32, and a current is supplied to the current sensing resistor Rs2. When the light emitting diode channels LED1 to LED3 emit light, a current path is provided by the switching circuit 33, and a current is supplied to the current sensing resistor Rs3.

The pulse generation units 261 to 263 operate by sensing voltages generated by their own current sensing resistors Rs1, Rs2, and Rs3, and output control pulses that are reset at the time point at which the current paths are provided, and have pulse widths gradually increasing or decreasing within sections in which the current paths are changed.

As a result, the current paths are sequentially provided by the switching circuits 31 to 33 according to an increase in the rectified voltage, and the switching circuits 31 to 33 switch the flow of a current by using switching pulses having pulse widths corresponding to the pulse widths of the control pulses (see FIG. 2) of the pulse generation units 261 to 263 corresponding to the switching circuits 31 to 33.

However, when the rectified voltage falls, the current path is shifted from a remote position to a near position based on the position at which the rectified voltage is applied. As a result, the switching pulses for controlling the light emission of the light source 12 include pulses having pulse widths gradually decreasing within each section, in which the current path is changed, according to the fall of the rectified voltage.

In the embodiments of FIG. 1 and FIG. 3, the pulse widths of the switching pulses output from the comparison units 50 of the switching circuits 31 to 33 are changed step by step within the sections according to a change in the rectified voltage, so that a current of a current path is independently controlled, and an current value follows the rectified voltage input as illustrated in FIG. 2.

What is claimed is:

1. A light emitting diode illumination apparatus comprising:

a light source that includes a plurality of light emitting diode channels including one or more light emitting diodes, and emits light by application of a rectified voltage obtained by converting an AC voltage; and a control circuit that selectively provides current paths according to a change in a level of the rectified voltage through a plurality of switching circuits connected to the light emitting diode channels, resets control pulses provided to the switching circuits at a time point at which the current paths are changed, and controls pulse widths of control pulses provided to the switching circuits such that a current supplied to the light source follows a waveform of the rectified voltage.

2. The light emitting diode illumination apparatus according to claim 1, wherein the control circuit independently controls a current of the current path.

3. The light emitting diode illumination apparatus according to claim 1, wherein the control circuit comprises:

a monitoring circuit that provides a monitoring voltage corresponding to a change in the rectified voltage;

a reference voltage generation circuit that provides reference voltages different from one another according to the switching circuits;

the plurality of switching circuits that provide the current paths according to a comparison result of the monitoring voltage and the reference voltages, and control the current by using the control pulses; and a pulse generation circuit that provides the plurality of switching circuits with the control pulses that are reset at a time point at which the current paths are provided, and have the pulse widths that gradually increase according to rise of the rectified voltage and gradually decrease according to fall of the rectified voltage.

4. The light emitting diode illumination apparatus according to claim 3, wherein the pulse generation circuit comprises:

a current sensing resistor that is commonly connected to the plurality of switching circuits and provides a sensing voltage corresponding to the current; and a pulse generation unit that receives the sensing voltage and generates the control pulse.

5. The light emitting diode illumination apparatus according to claim 1, wherein the control circuit comprises:

a monitoring circuit that provides a monitoring voltage corresponding to the rectified voltage;

a reference voltage generation circuit that provides reference voltages different from one another according to the switching circuits;

the plurality of switching circuits that provide the current paths according to a comparison result of the monitoring voltage and the reference voltages, and control the current by using the control pulses; and a plurality of pulse generation circuits that provide the plurality of switching circuits with the control pulses that are reset at a time point at which the current paths are provided, and have the pulse widths that gradually increase according to rise of the rectified voltage and gradually decrease according to fall of the rectified voltage.

6. The light emitting diode illumination apparatus according to claim 5, wherein each pulse generation circuit comprises:

a plurality of current sensing resistors that are connected to the plurality of switching circuits and provide a sensing voltage corresponding to the current; and a pulse generation unit that receives the sensing voltage and generates the control pulse.

7. The light emitting diode illumination apparatus according to claim 6, wherein the plurality of current sensing resistors of the pulse generation circuit have an equal resistance value.

8. The light emitting diode illumination apparatus according to claim 3, wherein the reference voltage generation circuit provides a high reference voltage to a switching circuit connected to a light emitting diode channel having a relatively high light emission voltage among the light emitting diode channels, and provides a low reference voltage to a switching circuit connected to a light emitting diode channel having a relatively low light emission voltage.

9. The light emitting diode illumination apparatus according to claim 3, wherein the switching circuit comprises:

a comparison unit that decides an output level according to the result obtained by comparing the monitoring voltage with the reference voltages, and outputs a switching pulse having a pulse width corresponding to the pulse width of the control pulse; and a switching element that selectively provides the current path in response to the switching pulse, and controls the current according to the pulse width.

10. The light emitting diode illumination apparatus according to claim 9, wherein the pulse generation circuit is configured to determine a time point, at which the current path is changed, by using the switching pulse.

11. A control method of a light emitting diode illumination apparatus using a rectified voltage having a level that rises or falls, the control method comprising the steps of:

providing a plurality of light emitting diode channels;

providing reference voltages for providing current paths according to the light emitting diode channels;

monitoring a change in the rectified voltage and providing a monitoring voltage; and providing a current path to a light emitting diode channel selected from the light emitting diode channels according to a result obtained by comparing the monitoring voltage with the reference voltages, and controlling a current supplied to the light source to follow a waveform of the rectified voltage by using a control pulse having a pulse width that changes and resets at a time point at which the current paths are changed.

12. The control method of a light emitting diode illumination apparatus according to claim 11, wherein a current of the current path is independently controlled.

13. The control method of a light emitting diode illumination apparatus according to claim 11, wherein the control pulse is reset at a time point at which the current path is provided, and is generated and provided to have a pulse width that gradually increases according to rise of the rectified voltage and gradually decreases according to fall of the rectified voltage.

14. The light emitting diode illumination apparatus according to claim 5, wherein the reference voltage generation circuit provides a high reference voltage to a switching circuit connected to a light emitting diode channel having a relatively high light emission voltage among the light emitting diode channels, and provides a low reference voltage to a switching circuit connected to a light emitting diode channel having a relatively low light emission voltage.

15. The light emitting diode illumination apparatus according to claim 5, wherein the switching circuit comprises:

a comparison unit that decides an output level according to the result obtained by comparing the monitoring voltage with the reference voltages, and outputs a switching pulse having a pulse width corresponding to the pulse width of the control pulse; and a switching element that selectively provides the current path in response to the switching pulse, and controls the current according to the pulse width.

* * * * *